US006976777B1

(12) United States Patent
Herold

(10) Patent No.: US 6,976,777 B1
(45) **Date of Patent: *Dec. 20, 2005**

(54) SIMULATED NEON-LIGHT TUBE

(75) Inventor: Michael A. Herold, Akron, OH (US)

(73) Assignee: Herold Design Group, LLC, Akron, OH (US)

( * ) Notice: Subject to any disclaimer, the term of this patent is extended or adjusted under 35 U.S.C. 154(b) by 160 days.

This patent is subject to a terminal disclaimer.

(21) Appl. No.: 10/792,249

(22) Filed: Mar. 2, 2004

Related U.S. Application Data

(63) Continuation of application No. 10/158,087, filed on May 29, 2002, now Pat. No. 6,726,350.

(51) Int. Cl.[7] ..... F21V 7/04

(52) U.S. Cl. ..... 362/555; 362/217; 362/216; 362/246; 362/251; 362/800; 362/231; 362/223; 362/240; 362/244; 362/184; 362/545; 362/489

(58) Field of Search ..... 362/555, 582, 362/217, 216, 246, 251, 800, 231, 223, 240, 244, 184, 545, 489

(56) References Cited

U.S. PATENT DOCUMENTS 6,149,285 A 11/2000 Cicarelli ..... 362/255
6,231,207 B1 5/2001 Kennedy et al. ..... 362/158
6,337,946 B1 1/2002 McGaffigan ..... 385/901
6,371,625 B2 * 4/2002 Campman ..... 362/184
6,726,350 B1 * 4/2004 Herold ..... 362/555

* cited by examiner

*Primary Examiner*—Sandra O'Shea
*Assistant Examiner*—Bertrand Zeade
(74) *Attorney, Agent, or Firm*—Renner, Kenner, Greive, Bobak, Taylor & Weber

(57) ABSTRACT

A simulated neon-light tube assembly (10) that is comprised of four major elements: a transparent tube (12) having a closed front end (16) and an open rear edge (18), a light-diffusing material (24), a light source (50) and a power source (60). The light-diffusing material (24) consists of stacks of thin acetate, or a like material, which are rolled and inserted into the tube (12) through the tube's open rear edge (18). The light source (50) can consist of a single LED (52) or an LED cluster. In either case, the LED(s) are located within a light-power assembly (70) that encloses the LED (52). The power source (60) for the LED can consist of an internal battery located within the assembly (70) or the assembly (70) can include a cable that is connected to an external battery. In either design, when the LED (52) illuminates, the light travels through the light emitting material (28) to cause the simulation of a neon-light.

21 Claims, 4 Drawing Sheets

SIMULATED NEON-LIGHT TUBE

RELATED APPLICATIONS

This application is a continuation of U.S. patent application Ser. No. 10/158,087 filed May 29, 2002 now U.S. Pat. No. 6,726,350.

TECHNICAL FIELD

The invention pertains to the general field of decorative lighting and more particularly to a battery operated, gasless tube that simulates the characteristics of a conventional neon tube.

BACKGROUND ART

One of the most popular and efficient means of attracting attention to a particular location or event is by using neon lighting. Since neon provides a unique type of bright glowing light, which can be created in various colors, neon is effective during daylight as well as nighttime.

Unfortunately, neon lighting does have some drawbacks. In order to use neon lighting a neon gas must be inserted into the tube and a relatively high voltage must be applied and maintained to keep the neon gas illuminated. Since the tubes in which the neon gas is held are made of glass, they are fragile and can easily break. When compared to other types of lighting, neon is expensive, especially when the neon lighting is made into a custom design. Once these drawbacks, as well as others, are taken into consideration, many people choose to use other more conventional types of lighting, even though a neon light would results in superior lighting.

Obviously, if there were some means of providing neon-like lighting without the inherent drawbacks of neon, it would be very beneficial. There have been attempts in the prior art to mimic neon light with conventional light that is projected or reflected/refracted off of, or through various types of lenses. While some of these efforts have been partially successful, the results are often achieved through more difficulty, complexity and expense than actual neon. The only truly effective replacement for neon will have to utilize a method that is less complex and is less expensive than actual neon, while providing a type of illumination that is substantially similar.

A search of the prior art did not disclose any literature or patents that read directly on the claims of the instant invention. However, the following U.S. patents are considered related:

| U.S. PAT. NO. | INVENTOR | ISSUED |
|---|---|---|
| 6,213,623 | Chapman | Apr. 10 2001 |
| 6,183,108 | Herold | Feb. 6 2001 |
| 5,980,063 | Ford, et al. | Nov. 9 1999 |
| 5,865,524 | Chapman | Feb. 2 1999 |
| 5,233,679 | Oyama | Aug. 3 1993 |

The U.S. Pat. No. 6,213,623 discloses a resilient water-tight light baton having a multi-colored solid-state light source and a power source mounted therein. The exterior walls of the light baton are machined to effectively transmit light from the light source. By pressing a single button the baton turns on and a steady color is emitted. By pressing the button again the color changes. By pressing and holding the button down, the selected color flashes. All interior electronics and solid state light sources are sealed from the outside atmosphere, thus making baton an explosion proof and waterproof design.

The U.S. Pat. No. 6,183,108 discloses a lighting apparatus, which includes a lens, such as a circular rod carried by a housing. A light is positioned adjacent the circular rod which has a convex entry portion and a convex exit portion to distribute a wide and intense beam of light to a desired area. Variations of the apparatus allow for distribution of the light in any desired pattern, either downward or outward. The apparatus eliminates the need for reflectors to assist in generating the beam, although mirrors may be employed to generate a triple high-intensity beam from a single light source.

The U.S. Pat. No. 5,980,063 discloses a light stick comprising an LED and a light-refracting tubular body having a longitudinal axis and made of a translucent or transparent plastic material. The tubular body tapers from a first open end of larger diameter to a second closed end of smaller diameter. The LED is mounted in the open end of the tubular body with the power source housed in an adjoining cap which is fitted onto the open end. The LED is aligned with the longitudinal axis of the tubular body, and a light-refracting network, is formed on the internal surface of the body to project light emitted by the LED towards the side and the closed end for the tubular body. In operation, the light rays are refracted and radiated and appear to glow evenly along the entire length of the light stick. The tapered surface allows easy disengagement of the tubular body from the plastic injection mold and works efficiently with many different electrical light sources.

The U.S. Pat. No. 5,865,524 discloses a resilient water-tight light baton that utilizes a multi-colored light source and power source mounted therein. The exterior walls of the light baton are machined to effectively transmit light from the light source. The body of the light baton further includes a ring switch that includes a magnetic portion. As the ring switch is rotated and the magnetic portion is brought proximate to the magnetic switches the light source is activated.

The U.S. Pat. No. 5,233,679 discloses a light transmitting body having a longitudinal axis and a light radiating surface extending substantially parallel to the axis. The body is an optical fiber, wherein the light radiating surface is the circumferential surface of the fiber. A plurality of striations are formed in the light radiating surface parallel to the axis which cause light entering the body along the axis to be radiated out of the body through the light radiating surface with substantially uniform intensity along the axis. The striations may be formed by molding, cold drawing, heating the body under tension, cutting, or by bundling and fusing a plurality of small optical fibers together.

DISCLOSURE OF THE INVENTION

The invention is designed to simulate the appearance and glow of a neon-light. The simulated neon-light tube in its basic design is comprised of:

A. A transparent tube having an inner surface, a closed front end, an open rear edge, a front outer surface, and a rear outer surface.

B. A light-diffusing material having a front terminus and a rear terminus.

C. A light source located within the open rear edge of the tube.

D. A power source connected to the light source, wherein when the light source is activated by the power source, the light is refracted along the light-diffusing material simulating the glow of a neon-light tube.

The transparent tube can be molded of glass or plastic, with a plastic material preferred. The length and diameter of the tube is dependent upon its ultimate usage. The diameter can range from 0.25 inches (0.635 cm) to 2.0 inches (5.08 cm).

The light-diffusing material is made of a plastic film having the properties that allow light to be evenly refracted along the length of the tube. The material, which has a preferred thickness of 0.002 mils, is stacked, rolled and inserted through the open rear edge of the transparent tube. When inserted, the front end of the rolled material is juxtaposed against the closed front end of the tube and the rear terminus is located adjacent the open rear edge of the tube. Thus, the light-diffusing material substantially covers the entire inner surface of the tube.

To cause the light-diffusing material to glow, a light source, which consists of at least one light emitting diode (LED) is utilized. The LED is located within the open rear edge of the tube adjacent the rear terminus of the light-diffusing material. The color of the LED or LEDS can be selected to provide singular colors or if the LEDS are in selected in clusters of different colors a blended color is produced.

To activate the invention, a power source is connected to the LED(s). The power source can be self-contained or can be hard-wired to a remote location. In the self-containing design an integrated, light/power assembly is employed that contains both the LED(s) and a set of batteries. The assembly is dimensioned to frictionally fit into the open rear edge of the tube. In the hard-wired design the assembly contains the LED which is connected to a front end of a cable having a second end that is connected to an external battery.

In view of the above disclosure, the primary object of the invention is to produce a simulated neon-light assembly that:

can be used in place of conventional neon lights, does not require the use of a gas, such as neon or argon or a phosphorescent substance, can be easily made of various lengths and diameters, can be made to include a single light source on one-end of a tube or the light source can be included to both ends of a tube, can be made in various colors, is cost effective from both a consumer's and manufacturer's point of view, and is releasably and virtually maintenance fee.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
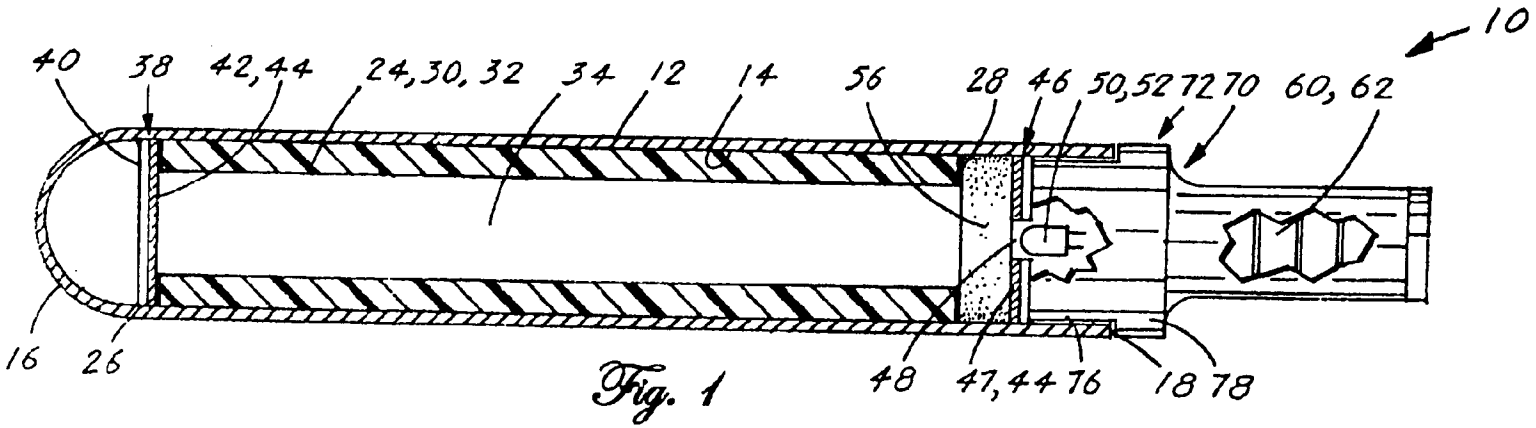
FIG. 1 is a side elevational/sectional view of a simulated neon-light tube assembly.

The best mode for carrying out the invention is presented in terms of a preferred embodiment for a light tube assembly that simulates the glow produced by a conventional neon light tube. The simulated neon-light tube assembly 10 as shown in FIGS. 1–11 is comprised of the following major elements: a transparent tube 12, a light-diffusing material 24, a light source 50 and a power source 60.

The transparent tube 12, as shown best in FIG. 1 can be molded of plastic or glass but preferably is molded of a plastic such as polystyrene or LEXON®. If glass is used a quartz silica also known as PYREX® is preferred. In all cases, the transparent tube 12 has an inside surface 14, a closed front end 16 and an open rear edge 18. The outside diameter of the tube can vary in accordance with its usage. For example, if the tube 12 is going to be used internally, such as within a vehicle, a 0.25 to 0.5 inch (0.635 to 1.27 cm) diameter is selected; if the tube is to be used externally to the vehicle or as a sign, the tube can range from 0.25 to 2.0 inches (0.635 to 5.08 cm). Additionally, the tube 12 can be molded to have a radiused closed front end 16, as shown in FIG. 1, or the closed front end can be flat (not shown).

Figure 2:
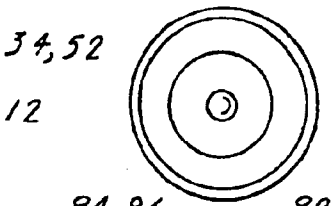
FIG. 2 is a front elevation/section view of the simulated neon-light tube assembly.
Figure 3:
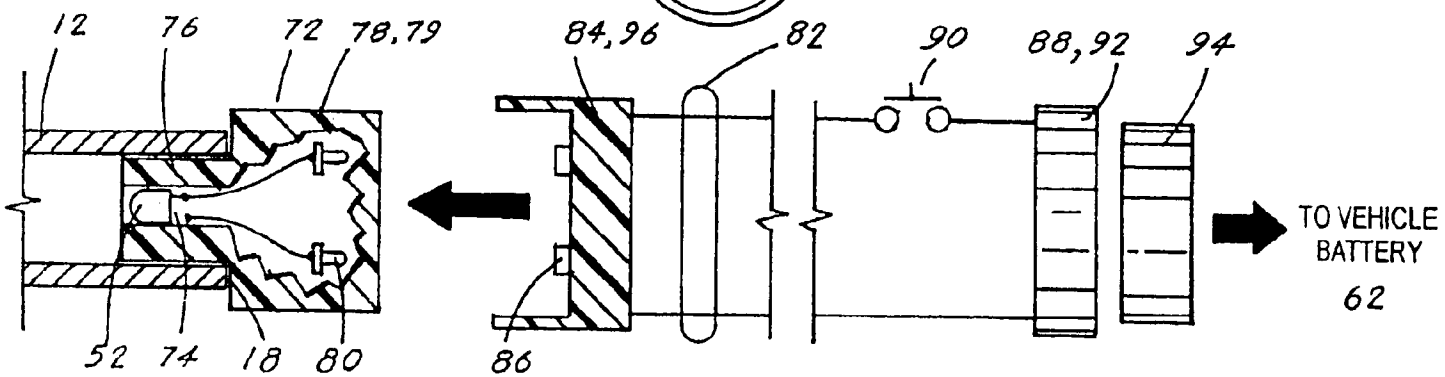
FIG. 3 is a side elevational/sectional view of an electrical design for powering the simulated neon-light tube assembly.

The light-diffusing material 24, as shown in FIGS. 1 and 3, is comprised of a plastic film that is selected from a group consisting of acetate, vinyl, polyethylene, polypropylene, and polyester. The light-diffusing material is purchased in sheets 30 having a thickness ranging from 0.001 to 0.003 mils with a 0.002 mil thickness preferred. The sheets are then stacked until a thickness of between 0.031 to 0.118 inches (0.080 to 0.476 cm) with a thickness of 0.125 inches (0.318 cm) preferred for most applications. After the thickness is selected, the sheets are formed into a light-diffusing roll 32 as best shown in FIG. 2. The rolled light-diffusing material 24 has a central longitudinal opening 34, a front terminus 26, and a rear terminus 28. The light-diffusing roll 32 is inserted through the open rear edge 18 of the tube 12 with the front terminus juxtaposed against the closed front end 16 of the tube 12 and the rear terminus 28 located adjacent the open rear edge 18 of the tube 12. When the roll is inserted it substantially covers the inner surface 14 of the tube 12.

The light source 50, as shown in its preferred mounting configuration in FIG. 1, is located within the open rear edge 18 of the tube 12, and is adjacent the rear terminus 28 of the light-diffusing roll 32. The light source in a preferred embodiment, is comprised of at least one light emitting diode (LED) 52. The LEDs are preferably of the ultrabright type which may incorporate or have added external to the LED a convex lens 53 or a concave lens 55. The convex or concave lenses 53, 55 are selected to produce a focused focal length that is optimal for the length of a particular tube 12.

Figure 7:
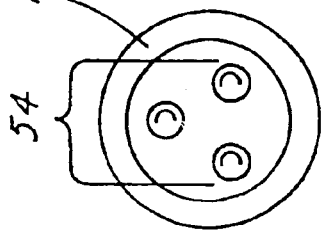
FIG. 7 is a front elevational view of an LED cluster.

Although a single LED 52 is preferred an LED cluster 54 consisting typically of three LEDs, as shown in FIG. 7, can also be used.

To power the LEDs 52 several electrical designs are presented in which a battery 62 is the power source for operating the at least one LED 52. The battery 62 can consist of a single cell or a series of button cells can be used.

In the first design, as shown in FIG. 3, a light/power assembly 70 is utilized that uses two separate elements: an LED/tube cap 72 and a separate cable assembly 82. The LED/tube cap 72 has a central opening 74, a front section 76, an integral rear section 78, and a receptacle 79. The central opening 74 is dimensioned to retain the at least one LED 52; the front section is dimensioned to frictionally fit into the open rear edge 18 of the transparent tube 12; the integral rear section 78 is dimensioned to abut with the open rear edge 18 of the tube 12 and incorporates a receptacle 79 that has a set of LED electrical male contacts 80.

The corresponding cable assembly 82, as also shown in FIG. 3, includes a front connector 84, a rear connector 88 and a power switch 90. The front connector 84 incorporates a set of female battery electrical contacts 86 that are dimensioned to interface with the set of LED electrical male contacts 80 located on the receptacle 79; the rear connector 88 includes a means for being connected to the terminals of the battery 62; and the power switch 90 is located in series between the first connector 84 and the rear connector 88. When the power switch is placed in an ON position and the front connector 84 is attached to the receptacle 79, the battery 62 energizes the at least one LED 52.

The simulated neon-light tube assembly 10 is designed to be utilized in a vehicle or in any other structure that can be enhanced by a neon type lighting. The power source 60 for activating the assembly 10 can consist of a regulated d-c power supply (not shown) that is connected to a utility power line, or a battery 60 that can consist of a vehicle battery 64 or a dedicated battery 66. When the assembly 10 is installed in a vehicle, the power source 60 is comprised of the vehicle battery 64. The battery 64 can be accessed through the vehicle ignition switch or, as shown in FIG. 3, by a rear connector 88 that is comprised of an electrical connector 92 that is designed to be plugged into a vehicle cigarette lighter receptacle 94. When the vehicle battery 64 is utilized in some cases, depending on the power level requirements of the LED, a voltage regulator 96, as also shown in FIG. 3, may be required to produce an output voltage at the correct level to power the at least one LED 52.

Figure 5:
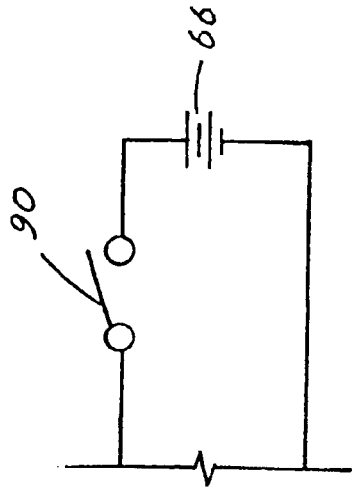
FIG. 5 is a schematic diagram of the electrical powering assembly shown in FIG. 4.
Figure 4:
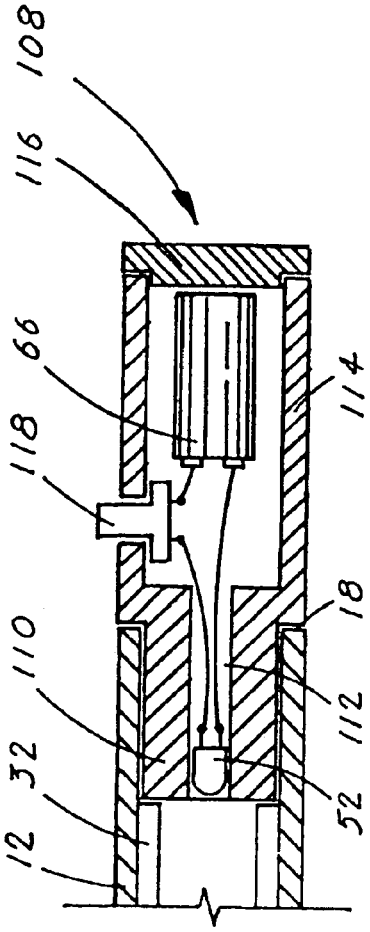
FIG. 4 is a side elevational/sectional view of an integrated electrical design for powering the simulated neon-light tube assembly.

When the assembly 10 is to be used in a remote location or when the vehicle battery 62 is not readily accessible, the dedicated battery 66 can be employed. In this design, as shown in FIGS. 1, 4 and 5, an integrated, light/power assembly 108 is utilized. The assembly 108 includes a front section 110, an integral rear section 114 and an accessible power switch 118. The front section 110 has a central opening 112 that is dimensioned to retain the at least one LED 52 and that is also dimensioned to frictionally fit in to the open rear edge 18 of the tube 12; the integral rear section 114 has a rear cap 116 and is dimensioned to enclose the dedicated battery 66 which is connected, via the switch 118, to the at least one LED 52. When the switch is placed in an ON position, the battery 66 energized the LED 52. The battery 62, in all cases, can consist of a single call or a series of button cells can be used.

Figure 8:
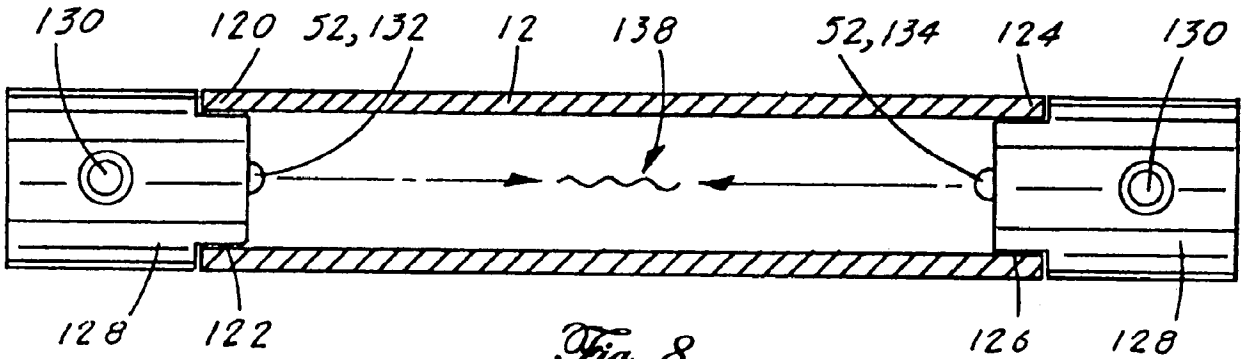
FIG. 8 is a side elevational/sectional view of a simulated neon-light tube that utilizes an LED on each end of the tube.

The primary design of the simulated neon-light tube assembly 10 can be modified as shown in FIG. 8. In this modified design, the tube 12 has a first end 120 having a first opening 122 and a second end 124 having a second opening 126. To the first opening 122 is attached a first LED 52 and to the second opening 126 is attached a second LED 52.

Each LED 52 is powered by a battery pack 128 that is activated by a switch 130. Alternatively, one battery pack 128 and switch 130 can be utilized to simultaneously turn-on both of the LEDs 52. To further enhance the aesthetics of the modified design, the LEDs can be selected to illuminate in different colors. For example, the first LED 52 can be selected to produce a red light and the second LED to produce a blue light. When the two LEDs illuminate they cause a purple or magenta glow to appear at substantially the center section of the tube 12.

Figure 6:
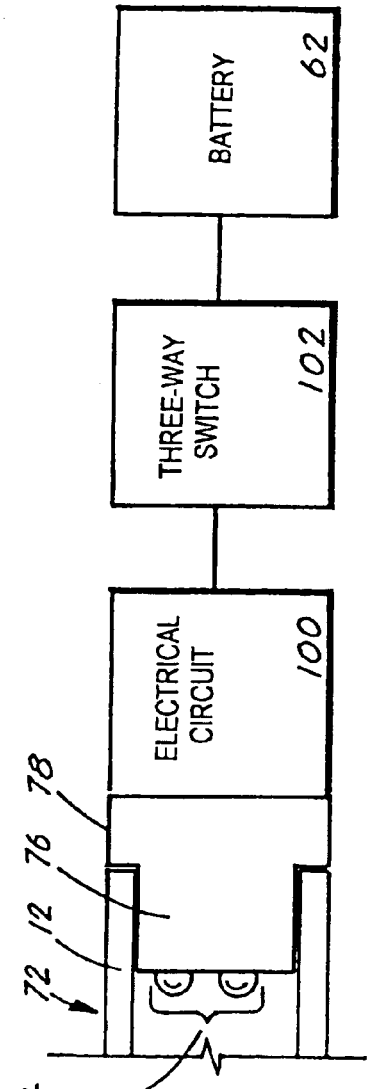
FIG. 6 is a block diagram of a simulated neon-light tube assembly that incorporates an LED cluster that is operated by an electronic circuit and a switch.

In all of the above designs the at least one LED 52 can be comprised of an LED cluster 54, as shown in FIGS. 6 and 7, that includes, for example, a red, white and blue LED. The LED clusters 54 is located within the LED/tube cap 72 and is connected to an electrical circuit 100. The circuit 100 is controlled by a three-position switch 102 that can be positioned to allow the LEDs to be individually turned on, turned on all at once, or in a preset sequence.

The primary design of the simulated neon-light assembly 10, as disclosed supra, can be enhanced by including a front light-reflecting disk 38, a rear light-reflecting disk 46, an LED circular shield 56, a plurality of ribbons and/or flakes 58, an opaque sleeve 140, and a reflective back shield 144.

The most innovative of these enhancements are the front light-reflecting disk 38 and the rear light-reflecting disk 46 both of which are shown in FIG. 1.

The front light-reflecting disk 38 has an outer surface 40 and a reflecting inner surface 42 that has a mirror finish 44. The disk 38 is located between the closed front end 16 of the tube 12 and the front terminus 26 of the light-diffusing roll 32. The front disk 38 allows a portion of the light impinging on the disk 38 to be reflected back into the tube 12 to produce an even distribution of light along the longitudinal surface of the tube 12.

The rear light-reflecting disk 46 also has a reflective inner surface 47 and a central opening 48 that is dimensioned to fit over the at least one LED 52 and against the front section of the LED/tube cap 72. The rear disk 46 functions in combination with the front light-reflecting disk 38 to further produce an even distribution of light along the longitudinal surface of the tube 12.

The LED circular shield 56 is located, as shown in FIG. 1, around the inner surface 14 of the tube 12 between the rear terminus 28 of the light-diffusing roll 32 and the front section of the LED/tube cap 72. The shield 56 is utilized to eliminate a bright spot that is otherwise visible at the starting point of the LED light beam.

Figure 9:
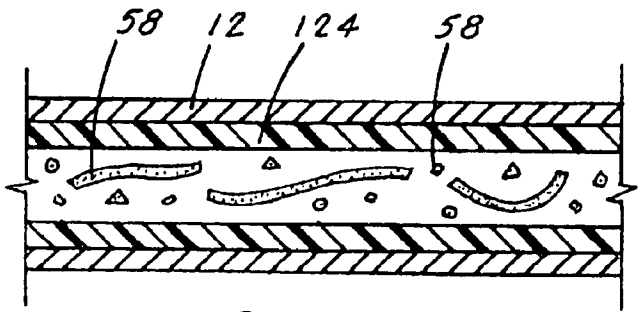
FIG. 9 is a side elevational/sectional view of a simulated neon-light tube that has inserted a plurality of loose ribbons and flakes that add to the aesthetics of the assembly.

The plurality of ribbons and/or flakes 58, as shown in FIG. 9, are loosely located within the central longitudinal opening 34 of the tube 12 or the ribbons and/or flakes can be rolled in place between layers of light-diffusing material 24. In either case, the ribbons and/or flakes can be made of fluorescing vinyl or color impregnated polyester. Alternatively, in lieu of loose ribbons or flakes, the ribbon or flakes can be permanently applied or etched directly onto the light-diffusing material 24. In whatever method is selected, the ribbons and/or flakes add to the aesthetics of the assembly 10. In particular, the loose ribbons and/or flakes 58 produce, in combination with the light from the at least one LED 52, a dynamic glow.

Figure 10:
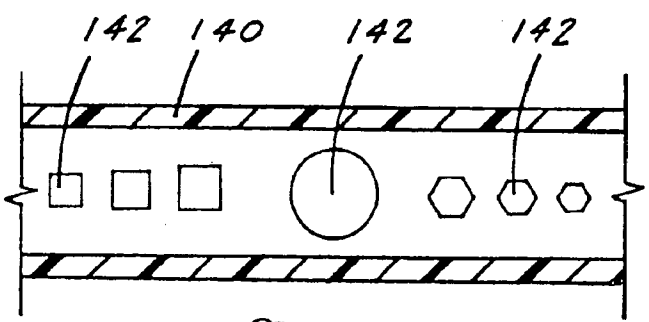
FIG. 10 is a side elevational view of an opaque sleeve that is inserted over the simulated neon-light tube. The sleeve has a plurality of openings through which the light from the tube is visible.

The opaque sleeve 140, as shown in FIG. 10 that is dimensioned to be inserted over the tube 12. The sleeve 140 can be made to include a plurality of narrow shaped openings 142 that allow the light from the tube to be visible only through the openings.

Figure 11:
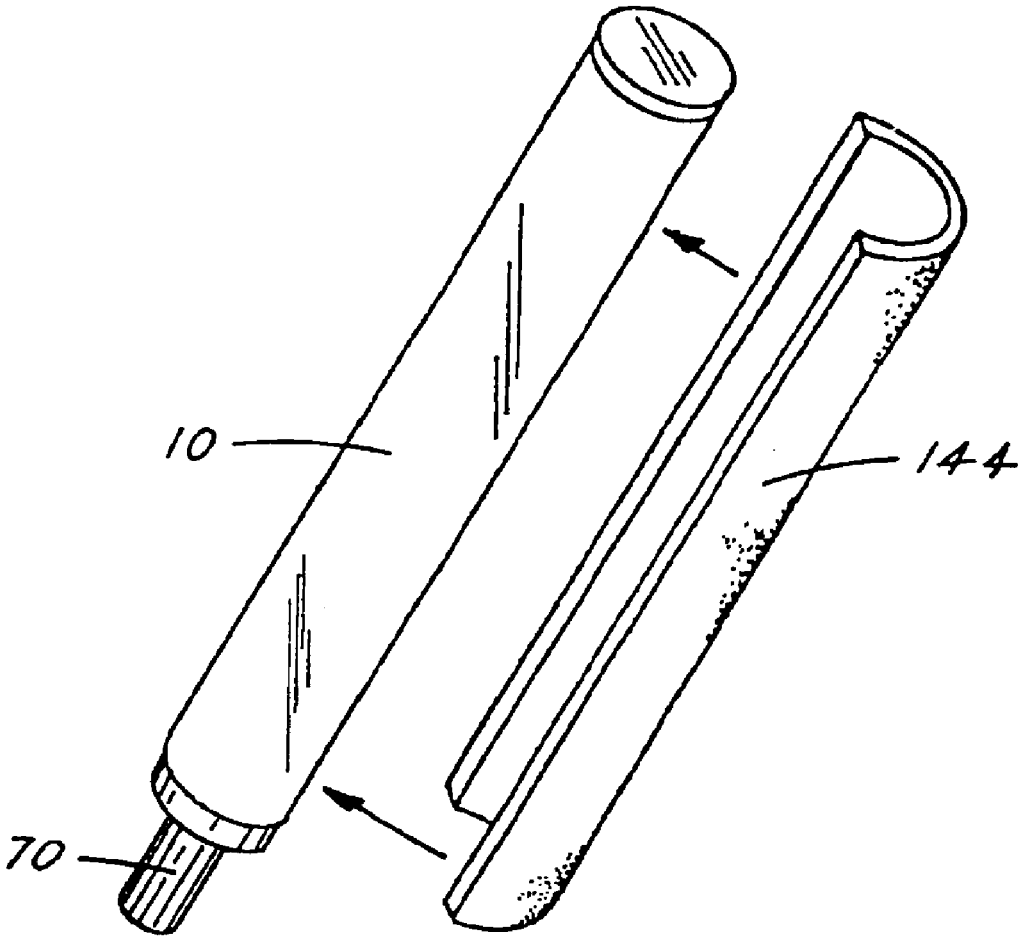
FIG. 11 is a perspective view of a tube to which is removably attached to the tubes rear outer surface a reflective back shield.

The final invention enhancement disclosed is the reflective back shield 144, as shown in FIG. 11. The shield 144, which covers substantially a 180-degree radius, includes a means for being snapped onto the rear outer surface 22 of the tube 12. The shield 144 functions by reflecting and redirecting light away from the surface facing the rear outer surface 22 of the tube 12. To further enhance the reflectiveness of the shield 144, the shield's inner surface 146 has a reflective coating 148 that augments the level of light being emitted from the front outer surface 20 of the tube 12. In lieu of the removable reflective back shield 144, the shield could be permanently inserted internally within the confines of the rear outer surface 22 of the tube 12. Alternatively, to the rear outer surface 22 of the tube 12 could be permanently affixed a coating of a shielding material.

While the invention has been described in complete detail and pictorially shown in the accompanying drawings it is not to be limited to such details, since many changes and modifications may be made to the invention without departing from the spirit and the scope thereof. For example, the tube 12 can be made in curved segments to allow a plurality of segments to be jointed together to form a circular structure. Hence, it is described to cover any and all modifications and forms, which may come within the language and scope of the claims.

What is claimed is:

1. A simulated neon-light tube assembly comprising:

a) a transparent tube having a open first end and a second end, and an inner and outer surface;

b) a light-diffusing material comprising a plastic film having a wall thickness ranging from 0.031 to 0.188 inches, and wherein said light-diffusing material substantially covers said inner surface of said tube, c) a light source located within and proximate to the open first end of said tube, d) a power source connected to said light source, wherein when said light source is activated by said power source, light is emitted and refracted along said light-diffusing material simulating the glow of a neon-light tube, and e) a light-reflecting disk having a reflecting inner surface and an outer surface, wherein said light-reflecting disk is located within and proximate to said second end of said tube such that a portion of said emitted light impinges on said disk and is reflected back into said tube to produce an even distribution of light along the inner surface of said tube.

2. The assembly as set forth in claim 1, wherein said transparent tube is made of plastic or glass.

3. The assembly as set forth in claim 1, wherein said light-diffusing material is a plastic film selected from a group consisting of acetate, vinyl, polyethylene, polypropylene, and polyester.

4. The assembly as set forth in claim 1, wherein said light-diffusing material is a polyester film.

5. The assembly as set forth in claim 1, wherein said light-diffusing material is a rolled sheet of plastic film having a central longitudinal opening.

6. The assembly as set forth in claim 5, wherein said rolled sheet of plastic film has a front terminus and a rear terminus, wherein said rolled sheet is inserted through the open first end of said tube with said front terminus juxtaposed at said second end of said tube and said rear terminus located adjacent said open first end of said tube.

7. The assembly as set forth in claim 1, wherein said reflecting inner surface of said light reflecting disk has a mirror finish.

8. The assembly as set forth in claim 1, wherein said light source is comprised of at least one light emitting diode (LED).

9. The assembly as set forth in claim 8, wherein said LED can incorporate or have added externally to said LED a convex or a concave lens that produces a focused focal length that is optimal for a particular length of said tube.

10. The assembly as set forth in claim 1, wherein said power source is comprised of a battery.

11. The assembly as set forth in claim 8, wherein said at least one LED is comprised of an LED cluster that includes a red, white and blue LED, wherein said LEDs are located within an LED/tube cap and are connected to an electrical circuit controlled by a three-position switch that allows the LEDs to be individually turned on, turned on all at once, or turned on in a preset sequence.

12. The assembly as set forth in claim 8, further comprising a light-deflecting disk having a reflective inner surface and central opening that fits over said at least one LED, wherein said light-deflecting disk functions in combination with said light-reflecting disk to further produce an even distribution of light along the longitudinal surface of said tube.

13. The assembly as set forth in claim 1, wherein said second end of said tube is closed.

14. The assembly as set forth in claim 1, wherein said second end of said tube is open, said assembly further comprising a second light source located within and proximate to said open second end of said tube.

15. The assembly as set forth in claim 14, wherein said light reflective disk has a central opening that fits over said light source.

16. The assembly as set forth in claim 14, further comprising a second light-reflecting disk having a reflective inner surface and central opening that fits over said first light source, wherein said first light-reflecting disk functions in combination with said second light-reflecting disk to further produce an even distribution of light along the longitudinal surface of said tube.

17. The assembly as set forth in claim 16, wherein said reflecting inner surface of said light reflecting disk has a mirror finish.

18. The assembly as set forth in claim 1, further comprising an opaque sleeve dimensioned to be inserted over said tube, wherein said sleeve having a plurality of openings that allow the light from said tube to be visible only through the openings.

19. The assembly as set forth in claim 1, further comprising a shield located on said inner surface of said transparent tube proximate said light source.

20. The assembly as set forth in claim 1, further comprising a reflective back shield attached to said outer surface of said transparent tube.

21. The assembly as set forth in claim 1, further comprising a reflective back shield located within said transparent tube.

* * * * *